US007292145B2

(12) United States Patent
Castle et al.

(10) Patent No.: US 7,292,145 B2
(45) Date of Patent: Nov. 6, 2007

(54) TAMPER SWITCH ARRANGEMENT

(75) Inventors: Scott T Castle, Canandaigua, NY (US); Paul F DeLozier, Walworth, NY (US); Ronald J Markese, Jr., Rochester, NY (US)

(73) Assignee: Robert Bosch GmbH, Stuttgart (DE)

( * ) Notice: Subject to any disclaimer, the term of this patent is extended or adjusted under 35 U.S.C. 154(b) by 126 days.

(21) Appl. No.: 11/065,191

(22) Filed: Feb. 24, 2005

(65) Prior Publication Data

US 2006/0197662 A1 Sep. 7, 2006

(51) Int. Cl.
*E05B 45/06* (2006.01)
*G08B 13/08* (2006.01)

(52) U.S. Cl. ..... 340/545.6; 340/542; 340/686.1; 340/568.1

(58) Field of Classification Search ..... 340/545.6; 700/11–13; 200/61.93
See application file for complete search history.

(56) References Cited

U.S. PATENT DOCUMENTS

| | | | | |
|---|---|---|---|---|
| 2,797,405 | A * | 6/1957 | Stelter | 340/570 |
| 3,797,006 | A * | 3/1974 | Reininger | 340/530 |
| 3,842,410 | A * | 10/1974 | Gopperton | 340/545.2 |
| 4,329,681 | A * | 5/1982 | Parsons | 340/545.6 |
| 4,605,922 | A | 8/1986 | Blattman et al. | 340/552 |
| 5,369,548 | A | 11/1994 | Combs | 361/643 |
| 5,764,729 | A | 6/1998 | Black et al. | 379/44 |
| 5,930,355 | A | 7/1999 | Poston | 379/451 |
| 6,061,447 | A | 5/2000 | Poston | 379/451 |
| 6,285,912 | B1 | 9/2001 | Ellison et al. | 700/11 |
| 6,778,083 | B2 * | 8/2004 | Auerbach et al. | 340/539.1 |
| 2003/0060156 | A1 | 3/2003 | Giaccherini et al. | 455/3.01 |
| 2004/0066275 | A1 | 4/2004 | Mickler | 340/5.33 |

FOREIGN PATENT DOCUMENTS

EP 1 494 188 A1 1/2005

* cited by examiner

*Primary Examiner*—Benjamin C. Lee
*Assistant Examiner*—Jennifer Mehmood
(74) *Attorney, Agent, or Firm*—Baker & Daniels LLP

(57) ABSTRACT

A tamper switch arrangement detects tampering with a device, and includes a tamper switch assembly having a tamper switch with a first part and a second part. The first and second parts are movable relative to each other between an open switch position and a closed switch position. The tamper switch is biased into one of the open and closed switch positions. An enclosure substantially encloses the tamper switch assembly and the device. The enclosure includes a door and an opening disposed opposite the door. The enclosure is sized such that the tamper switch assembly may be compressed between an inner surface of the door and a second surface via the opening to thereby overcome the bias and actuate the tamper switch into an other of the open and closed switch positions.

30 Claims, 7 Drawing Sheets

TAMPER SWITCH ARRANGEMENT

BACKGROUND OF THE INVENTION

1. Field of the Invention

The present invention relates to systems for detecting unauthorized tampering with a device, and, more particularly, to systems for detecting unauthorized tampering with a device that is disposed within an enclosure.

2. Description of the Related Art

Many devices must be placed in locations where they may be exposed to unauthorized tampering or theft. Such devices include controllers for telephone systems, alarm systems, cable television systems, firearms, art work and other valuables, for example. In order to protect the devices from tampering and other forms of physical harm, they may be placed within security system enclosures in the form of boxes that are attached to fixed structures such as ceilings, walls, floors and posts. The boxes may have hinged covers for enabling authorized access to the devices within the boxes, and theses doors may be locked shut.

The security system enclosures commonly employ tamper switches for detecting that the cover of the enclosure has been opened, or that the enclosure has been removed from the fixed structure to which it was attached. A typical tamper switch has a pair of contacts that may be opened or closed as a result of the enclosure door being opened, or as a result of the enclosure being removed from the fixed structure. A problem, however, is that separate switches must be used for detecting the opening of the door and the removal of the enclosure from the fixed structure. That is, one tamper switch may detect the opening of the door, and a separate tamper switch may be required to detect the removal of the enclosure from the wall. The use of two separate switches adds to the cost and increases the size of the tamper detection system.

What is needed in the art is a tamper switch arrangement that utilizes a single tamper switch to detect both the opening of a door of the security system enclosure and the removal of the enclosure from the fixed structure on which it is mounted.

SUMMARY OF THE INVENTION

The present invention provides a tamper switch arrangement including an enclosure containing a tamper switch assembly having only a single tamper switch. The tamper switch assembly may be compressed between a front door of the enclosure and a fixed structure to which the arrangement is mounted through an opening in the rear of the enclosure. If the door is opened or if the enclosure is removed from the fixed structure, the tamper switch will be actuated from a closed switch position to an open switch position, or vice versa, thereby enabling the transmission of an alarm signal indicative of the tampering.

The invention comprises, in one form thereof, a tamper switch arrangement for detecting tampering with a device. The tamper switch arrangement includes a tamper switch assembly having a tamper switch with a first part and a second part. The first and second parts are movable relative to each other between an open switch position and a closed switch position. The tamper switch is biased into one of the open and closed switch positions. An enclosure substantially encloses the tamper switch assembly and the device. The enclosure includes a door and an opening disposed opposite the door. The enclosure is sized such that the tamper switch assembly may be compressed between an inner surface of the door and a second surface via the opening to thereby overcome the bias and actuate the tamper switch into an other of the open and closed switch positions.

In another form, the invention comprises a tamper detection assembly for placement within an enclosure. The assembly includes a tamper switch having a first part and a second part. The first and second parts are movable relative to each other between an open switch position and a closed switch position. The tamper switch is biased into one of the open and closed switch positions. The tamper switch is compressed between an inner surface of a front door of the enclosure and a second surface via a rear opening of the enclosure such that the bias is overcome and the tamper switch is actuated into an other of the open and closed switch positions. A spring is operably coupled between the tamper switch and one of the opening and the door of the enclosure. The spring is configured to be compressed upon closing of the door after the tamper switch has been actuated into the other of the open and closed switch positions.

In yet another form, the invention comprises a tamper detection assembly for placement within an enclosure. The assembly includes a tamper switch having a first part and a second part. The first and second parts are movable relative to each other between an open switch position and a closed switch position. The tamper switch is biased into one of the open and closed switch positions. A switch actuator is operably coupled to the tamper switch and actuates the tamper switch into an other of the open and closed switch positions in response to the tamper detection assembly being compressed between an inner surface of a front door of the enclosure and a second surface via a rear opening of the enclosure.

An advantage of the present invention is that a single tamper switch may be used to detect both the opening the enclosure door and the removal of the enclosure from the fixed structure to which it is mounted.

Another advantage is that the tamper switch assembly has an adjustable length and includes a compressible spring in order to accommodate enclosures of different depths.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
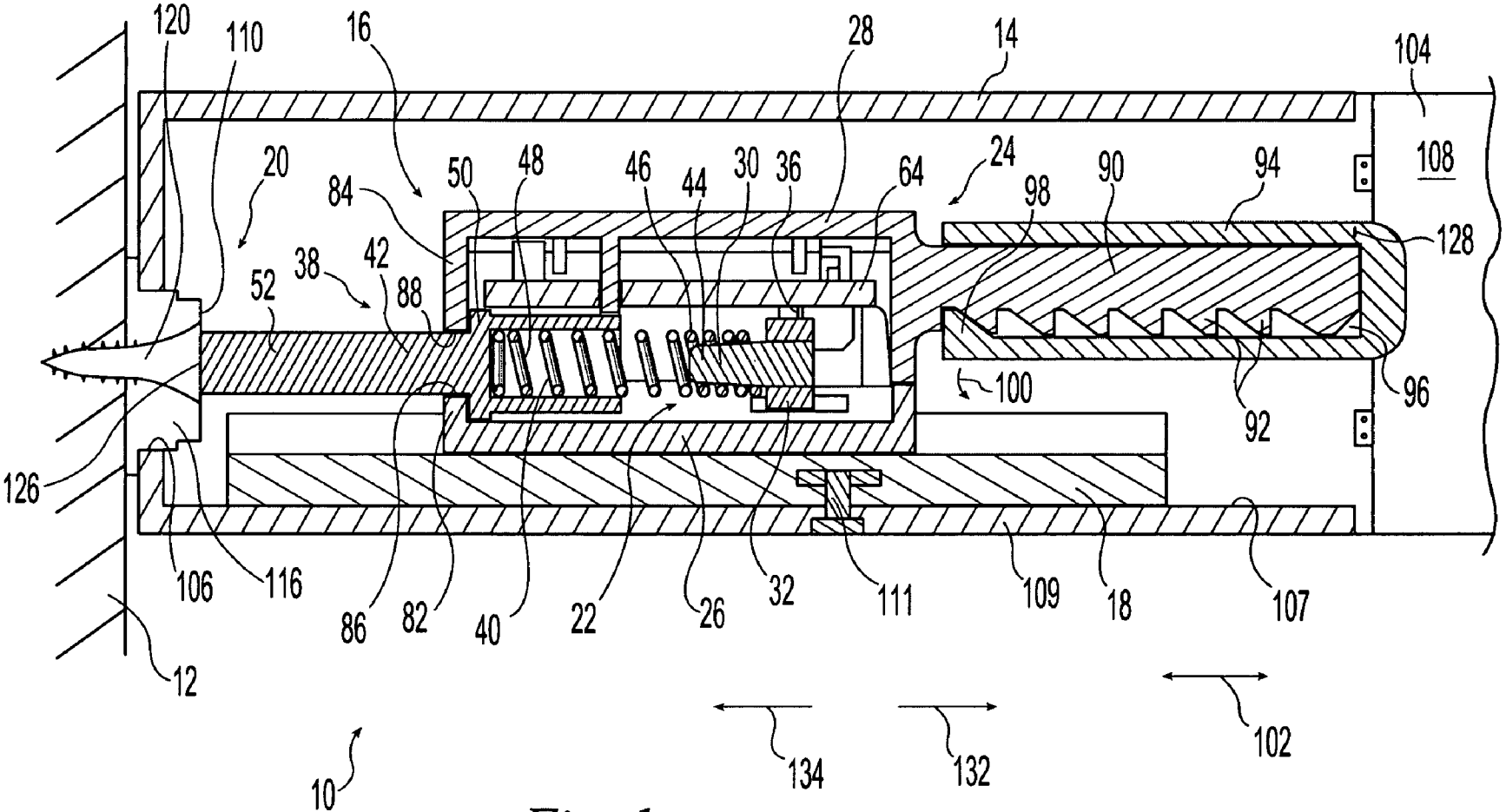
FIG. 1 is a cross-sectional view of one embodiment of a tamper switch arrangement of the present invention with the enclosure door open.

Corresponding reference characters indicate corresponding parts throughout the several views. Although the exemplifications set out herein illustrate the invention, in one form, the embodiments disclosed below are not intended to be exhaustive or to be construed as limiting the scope of the invention to the precise form disclosed.

DESCRIPTION OF THE PRESENT INVENTION

Referring now to the drawings, and particularly to FIG. 1, there is shown one embodiment of a tamper switch arrangement 10 of the present invention attached to a wall 12. Arrangement 10 includes an enclosure 14, a tamper switch assembly or "tamper detection assembly" 16, a rail 18 and a plug assembly 20.

Figure 2:
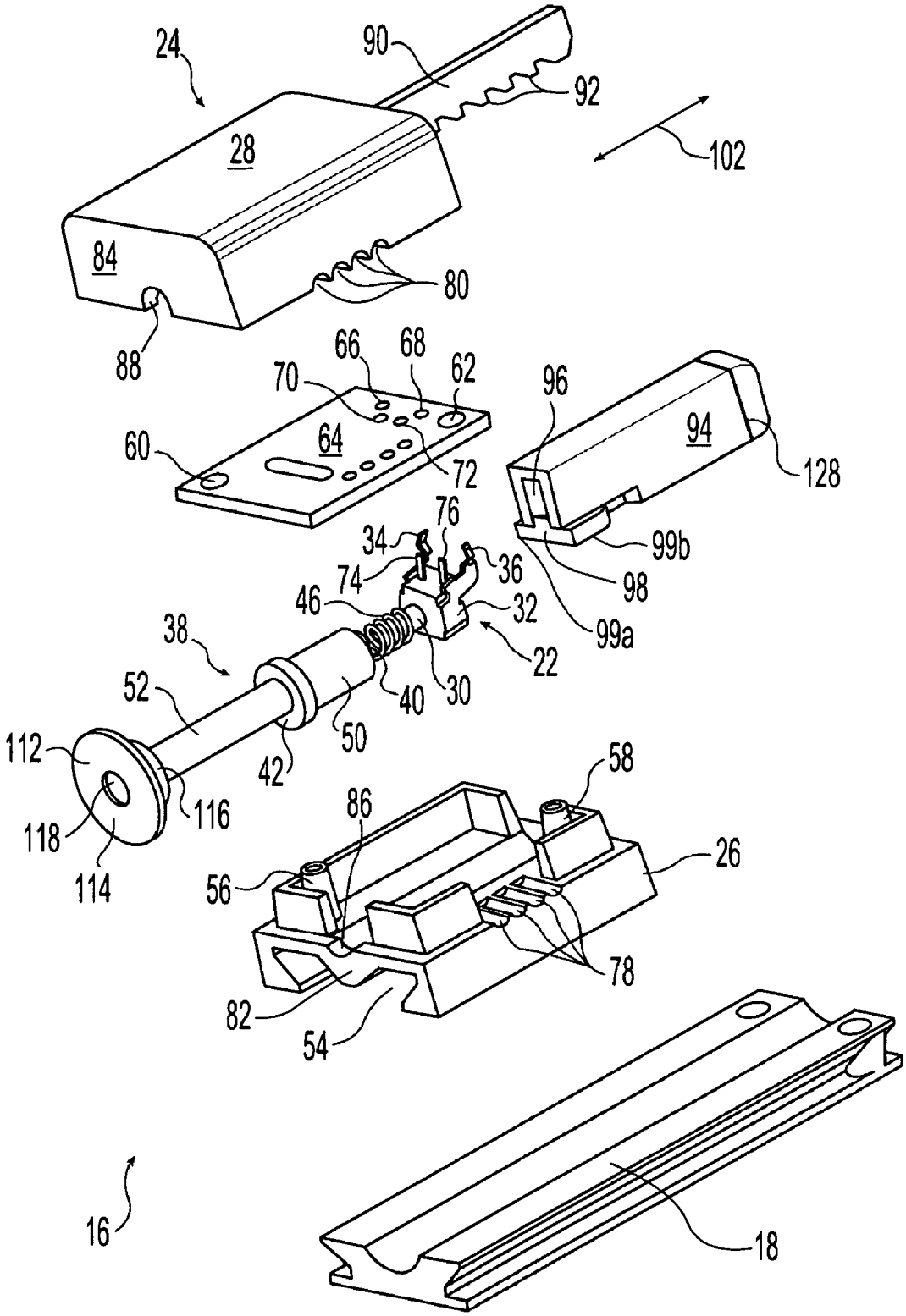
FIG. 2 is an exploded view of the tamper switch assembly, rail and plug of the tamper switch arrangement of FIG. 1.

As best illustrated in FIG. 2, tamper switch assembly 16 includes a tamper switch 22 disposed within a housing 24 having a bottom housing half 26 and a top housing half 28. Tamper switch 22 includes two parts that are movable relative to each other. More particularly, tamper switch 22 includes a rod 30 that is slidable or otherwise movable relative to a switch body 32 to thereby toggle switch 22 between a closed switch position in which a pair of switch contacts 74, 76 are electrically connected together and an open switch position in which contacts 74, 76 are electrically disconnected from one another.

A switch actuator 38 includes a coil spring 40 and a plunger 42. A first end 44 of rod 30 is securely received in first end 46 of spring 40. A second end 48 of spring 40 is received in a spring retainer cup 50 of plunger 42. A shaft 52 extends from a closed end of cup 50.

Figure 3:
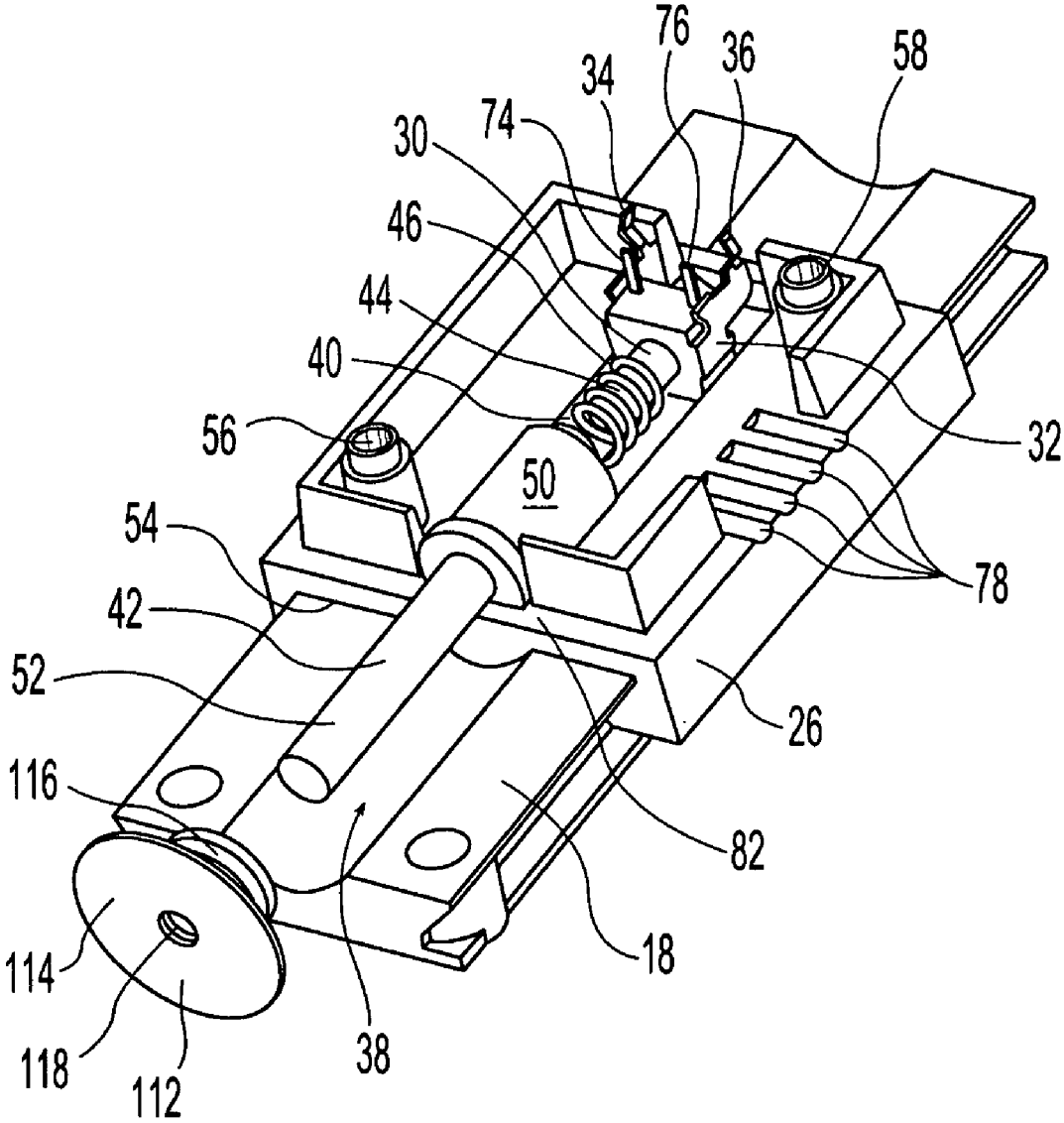
FIG. 3 is a perspective view of the bottom housing half, tamper switch, and switch actuator of the tamper switch assembly of FIG. 2, and the rail and plug of the tamper switch arrangement of FIG. 1.
Figure 4:
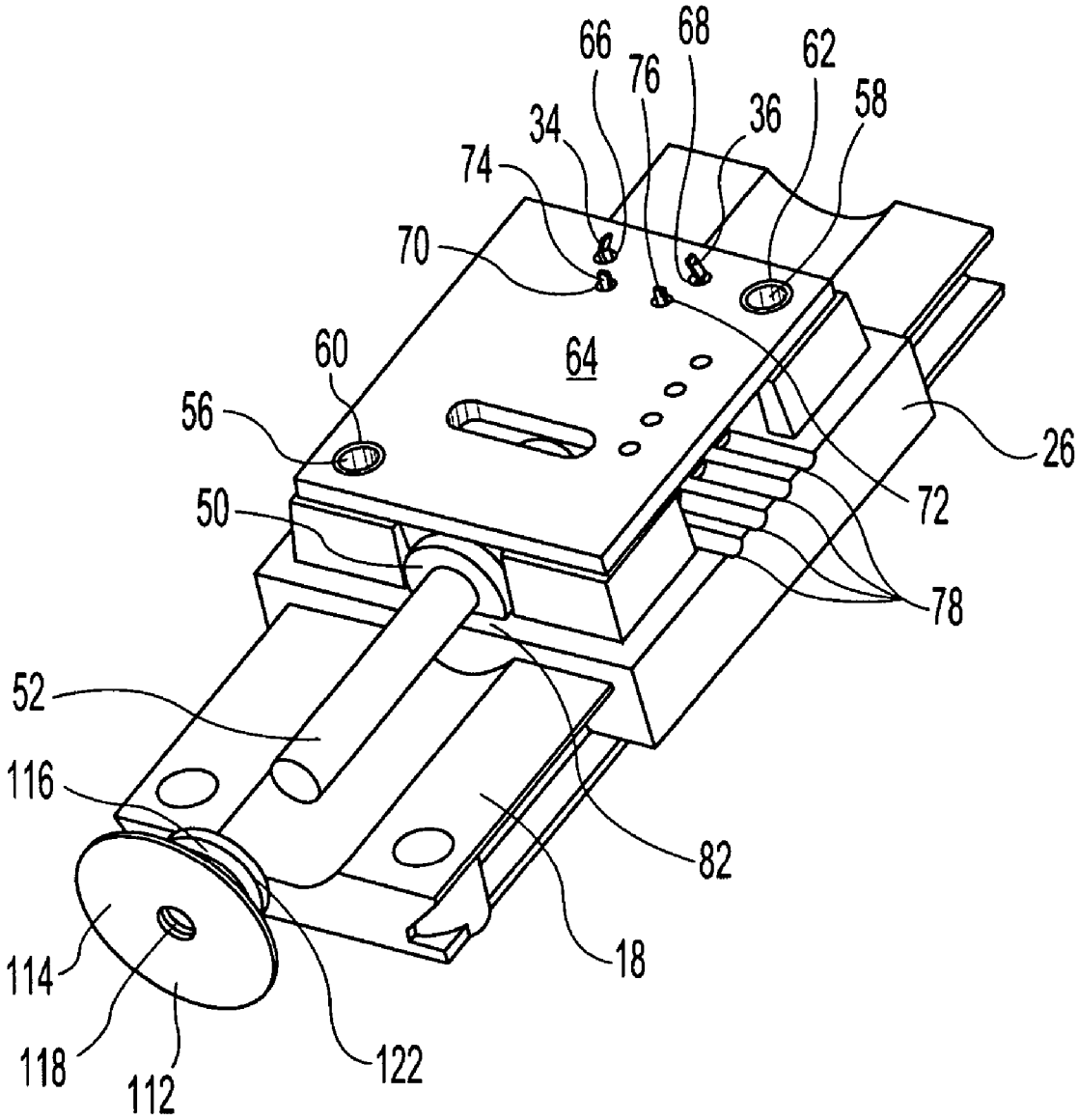
FIG. 4 is a perspective view of the bottom housing half, tamper switch, switch actuator and printed circuit board of the tamper switch assembly of FIG. 2, and the rail and plug of the tamper switch arrangement of FIG. 1.

Bottom housing half 26 includes a groove 54 for slidingly receiving rail 18, as best illustrated in FIG. 3. A pair of posts 56, 58 may be received in respective throughholes 60, 62 of a printed circuit board (PCB) 64 to thereby mechanically support PCB 64 on bottom housing half 26, as best shown in FIG. 4. Although only two posts 56, 58 and only two throughholes 60, 62 are shown in the drawings, four posts and four throughholes may be provided for additional support. That is, a respective post may be provided on each of the four corners of bottom housing half 26, and a respective throughhole may be provided in each of the four corners of PCB 64. PCB 64 includes a pair of throughholes 66, 68 for receiving respective mounting supports 34, 36 for switch 22. PCB 64 also includes a pair of plated throughholes 70, 72 for receiving respective contacts 74, 76 of tamper switch 22. Contacts 74, 76 may be soldered to PCB 64 and to respective wires (not shown) that lead out of housing 24. Opposing notches 78, 80 on bottom housing half 26 and top housing half 28, respectively, conjointly form channels through which the wires may lead out of housing 24.

Bottom housing half 26 includes an end wall 82 that limits the movement of cup 50 away from switch 22 due to the force of spring 40. As can be seen in FIGS. 1, 3 and 4, cup 50 may abut end wall 82. Similarly, top housing half 28 includes an end wall 84 against which cup 50 may also abut, as shown in FIG. 1, and which also limits the movement of cup 50. Opposing notches 86, 88 in respective end walls 82, 84 conjointly form a channel through which shaft 52 may slide.

Top housing half 28 includes an elongate element in the form of a cantilever 90 having aligned, angled teeth 92 along its length. Another elongate element in the form of a door strike 94 includes a slot 96 in which cantilever 90 may be retainingly received. At the front end of slot 96 is a flexible pawl 98 having wings 99*a*, 99*b* which may be gripped and rotated in the direction of arrow 100 to allow cantilever 90 to be inserted into slot 96. When door strike 94 is at a desired point along the length of cantilever 90, wings 99 may be released in order to allow pawl 98 to settle into one of the notches between teeth 92. Thus, door strike 94 is selectively couplable to cantilever 90 at a plurality of points along the length of cantilever 90. Cantilever 90 and door strike 94 conjointly form an elongate device having an adjustable length in the longitudinal directions indicated by double arrow 102.

Figure 5:
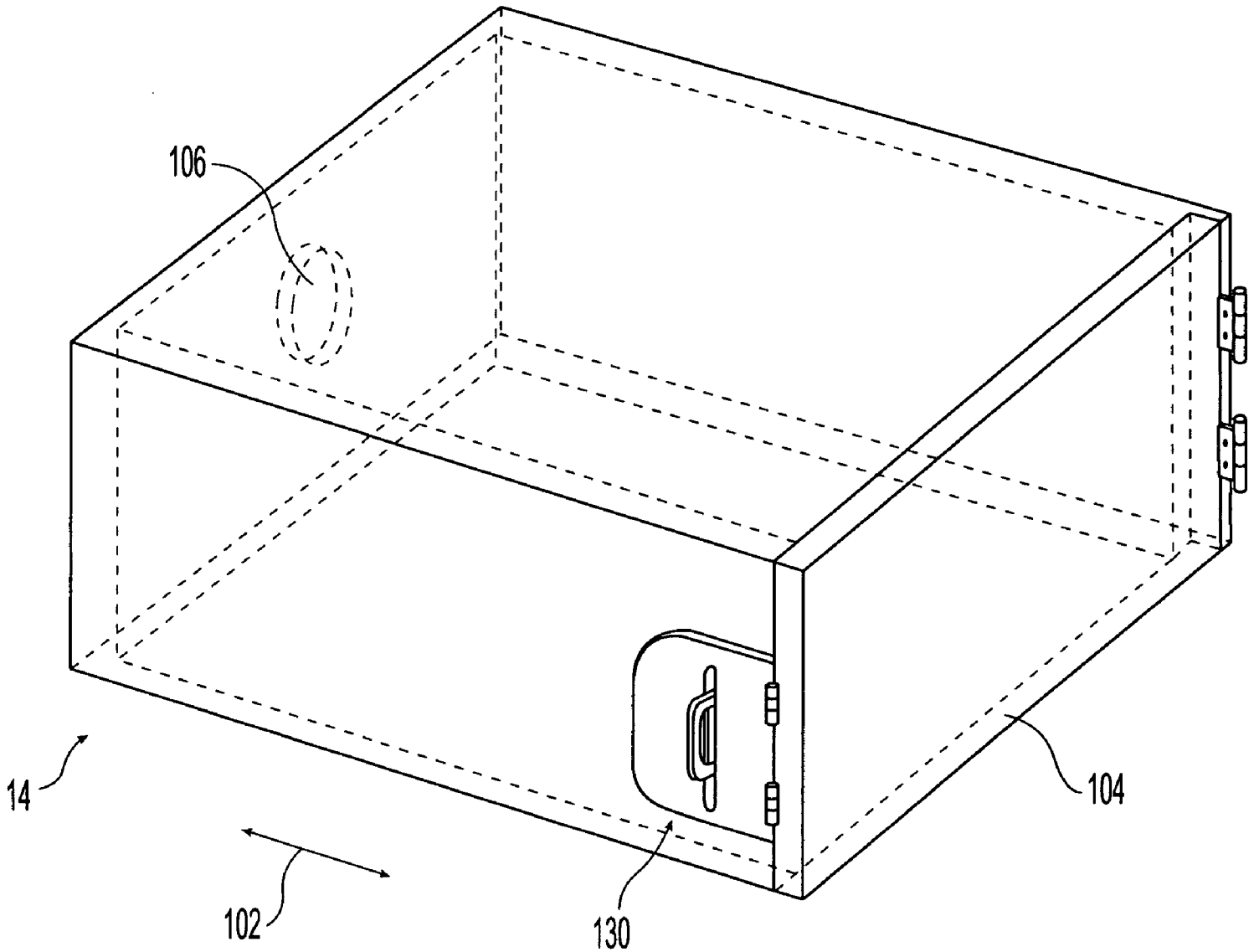
FIG. 5 is a perspective view of the enclosure of the tamper switch arrangement of FIG. 1.

Enclosure 14 may substantially enclose tamper switch assembly 16 and the device (not shown), such as an alarm system, that enclosure 14 is to protect from tampering. As best illustrated in FIG. 5, enclosure 14 may be in the form of a rectangular box having a hinged front door 104 and a rear opening 106 disposed opposite door 104. In the embodiment shown, opening 106 is in the form of a circular throughhole. Enclosure 14 may be sized, e.g., may have a length in directions 102, such that tamper switch assembly 16 may be compressed between an inner surface 108 (FIG. 6) of door 104 and a surface 110 of plug assembly 20 that extends into enclosure 14 via opening 106. An inner surface of a wall of enclosure 14, such as inner surface 107 of bottom wall 109, may be attached to rail 18 via an anchoring device 111. Enclosure 14 may also include a channel (not shown) for carrying one or more wires (not shown) leading from tamper switch 22 to a device, such as an alarm (not shown), disposed outside of enclosure 14. Via the wires and switch 22, the alarm may be activated by an alarm system protected within enclosure 14.

Plug assembly 20 includes a plug 112 having a disc-shaped base 114 and a toroidal main part 116. Plug 112 has a fastener hole 118 extending therethrough for receiving a fastener 120 for fastening plug 112 to wall 12. Fastener 120 is shown in the drawings as a screw. However, it is also possible for fastener 120 to be in the form of a nail, wall anchor, etc. An outer surface 122 of main part 116 and an exposed outer surface 124 (FIG. 6) of fastener 120 conjointly form surface 110 of plug assembly 20. Fastener 120 may immovably fasten plug 112 to wall 12 such that plug assembly 20 is a fixed structure. However, it is also possible for fastener 120 to rotatably fasten plug 112 to wall 12 such that plug 112 may rotate about fastener 120. Main part 116 may extend from base 114 at a right angle to thereby provide an annular shoulder that is sized to be snugly received in opening 106. That is, a width of main part 116 may closely match the width of opening 106.

Figure 6:
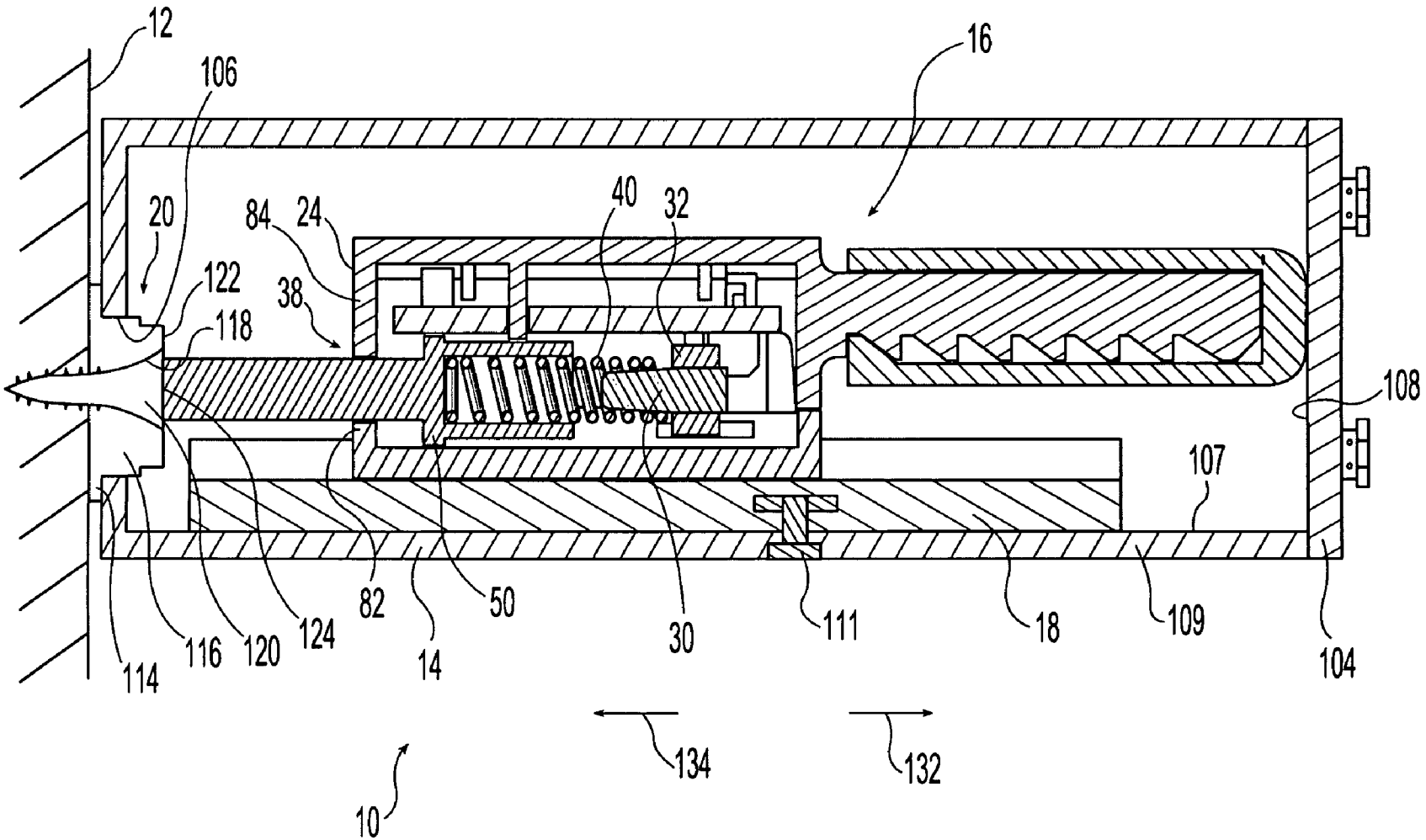
FIG. 6 is a cross-sectional view of the tamper switch arrangement of FIG. 1 with the enclosure door closed.

In operation, enclosure 14 is moved toward wall 12 such that opening 106 is placed over main part 116 of plug 112. Movement of enclosure 14 toward wall 12 is continued until enclosure 14 abuts base 114 of plug 112, as shown in FIG. 6. Enclosure 14 may then be attached to wall 12 via some attachment apparatus (not shown), such as brackets that are attached to both wall 12 and enclosure 14 via bolts, for example.

Tamper switch assembly 16 may be inserted into enclosure 14 through an open door 104. Groove 54 of housing 24 may be aligned with rail 18 such that rail 18 is received in groove 54 as tamper switch assembly 16 is inserted into enclosure 14. Tamper switch assembly 16 may be slid along rail 18 in directions 102 generally aligned with door 104 and opening 106. Tamper switch assembly 16 may be slid along rail 18 until a distal end 126 (FIG. 1) of shaft 52 abuts surface 110 of plug assembly 20, as shown in FIG. 1. In this uncompressed state of tamper switch assembly 16, the relative positions of rod 30 and body 32 of tamper switch 22 are as shown in FIG. 1. In one embodiment, this relative positioning of rod 30 and body 32 places switch 22 in an open switch position. That is, there is no electrical connection between contacts 74, 76. Tamper switch 22 may include a biasing device (not shown) that biases rod 30 and body 32 into their relative positions as shown in FIG. 1, i.e., that biases switch 22 into the open switch position. The biasing device of tamper switch 22 may be a leaf spring or some other type of spring, for example.

Door strike 94 may now be coupled to top housing half 28 at a desired one of the plurality of points along the length of cantilever 90. More particularly, wings 99 may be gripped and pawl 98 may be rotated in direction 100 away from teeth 92. Door strike 94 may then be slid freely along the length of cantilever 90 until strike 94 reaches the desired position. Wings 99 may then be released to thereby allow pawl 98 to releaseably lock into a notch between a desired pair of adjacent teeth 92. In one embodiment, door strike 94 is positioned on cantilever 90 such that door strike 94 extends a desired distance past the end of an enclosure wall, such as wall 109. Further, door strike 94 may be positioned on cantilever 90 such that door strike 94 extends a predetermined distance past the end of an enclosure wall. In order to facilitate such positioning, door strike 94 may be provided with a mark 128 that may be aligned with the end of a wall, such as wall 109. The farther door strike 94 extends past the ends of the enclosure walls, the greater the level of compression of switch assembly 16 when door 104 is closed. Thus, the elongate device formed by cantilever 90 and door strike 94 has a length that is adjustable to set a level of compression of switch assembly 16.

Next, door 104 of enclosure 14 may be closed as shown in FIG. 6 such that tamper switch assembly 16 is compressed between inner surface 108 of door 104 and surface 110 of plug assembly 20 via opening 106. In response to this compression of tamper switch assembly 16, switch actuator 38 may actuate tamper switch 22 into an other position, i.e., a closed position in which contacts 74, 76 are electrically connected together. More particularly, as tamper switch assembly 16 is compressed, housing 24 may slide along rail 18 toward wall 12. Plunger 42, which abuts plug assembly 20, remains fixed during the compression. Thus, spring 40 is compressed between plunger 42 and rod 30 and thereby increases the force that it exerts on rod 30. The increased force on rod 30 overcomes the bias of the biasing device of switch 22 and causes rod 30 to slide into a position as shown in FIG. 6 relative to body 32. In one embodiment, this relative positioning of rod 30 and body 32 places switch 22 in a closed switch position. That is, there is an electrical connection, i.e., an electrical short, between contacts 74, 76. Cover 104 may be latched and possibly locked in the closed door position via use of latching mechanism 130 or any other suitable latching mechanism. A continuous electrical signal may be applied to one of contacts 74, 76 and may be carried through the other one of contacts 74, 76 to an alarm system. In this condition, tamper switch arrangement 10 is set to detect tampering with a device disposed within enclosure 14.

If someone does tamper with the device, such as by first opening door 104 in order to gain access to the device, then the force of spring 40 may push housing 24, via rod 30, in a direction 132 away from wall 12. With spring 40 expanding and exerting less force on rod 30, the biasing device of switch 22 may again overcome the force of spring 40 and return rod 30 and body 32 to their positions as shown in FIG. 1, i.e., the open switch position. The force of spring 40 causes housing 24 to move still farther in direction 132 until cup 50 abuts end walls 82, 84 and the entire tamper switch arrangement 10 has returned to its position as shown in FIG. 1. The loss of electrical connection between contacts 74, 76 terminates the transmission of the electrical signal to the alarm system and signifies to the alarm system that someone may have gained access to the device within enclosure 14.

Figure 7:
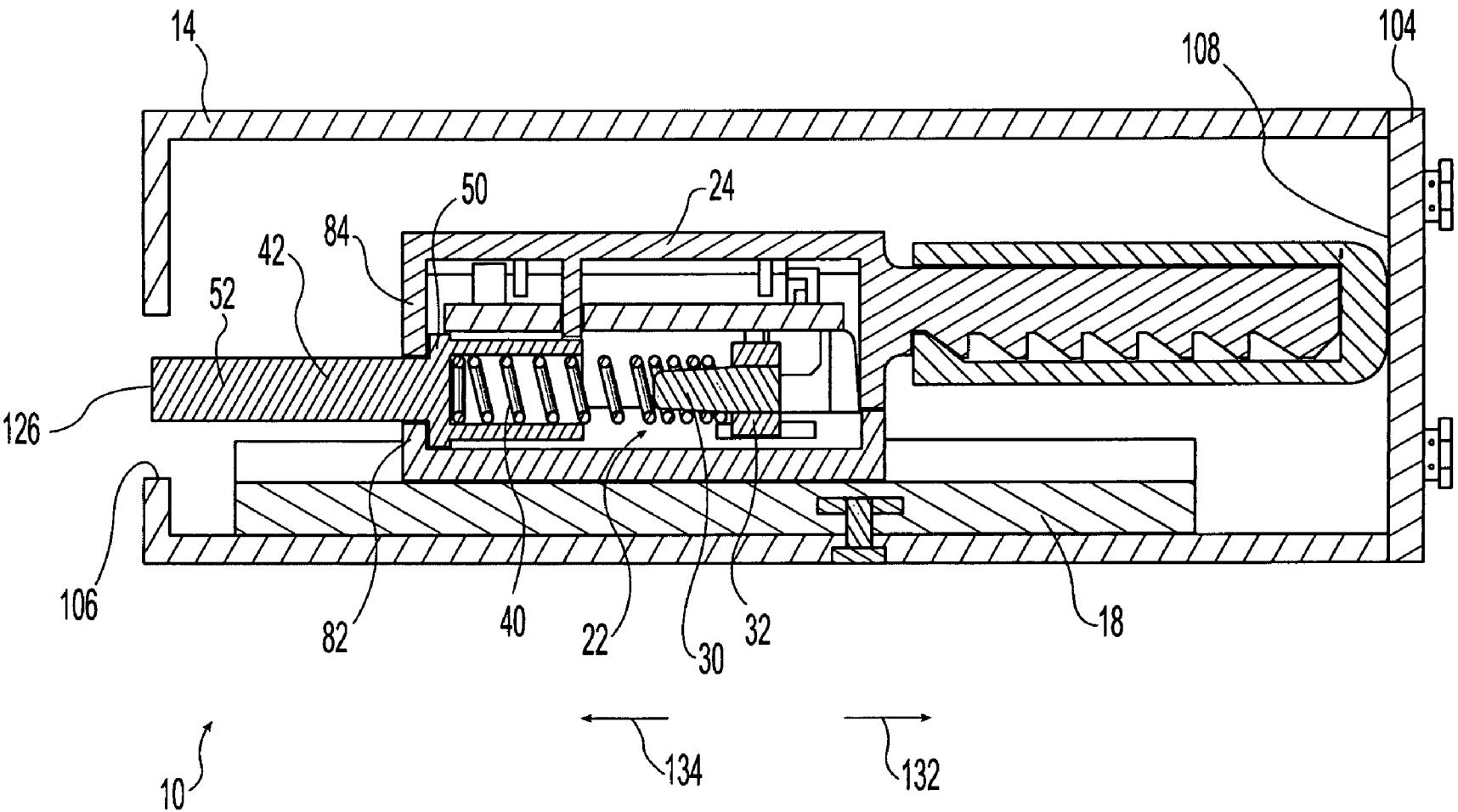
FIG. 7 is a cross-sectional view of the enclosure, rail, and tamper switch assembly of the tamper switch arrangement of FIG. 1 in a position away from the wall and the plug assembly.

If someone tries to gain access to the device by pulling enclosure 14 off of wall 12 such that plug assembly 20 no longer occupies opening 106, then the force of spring 40 may push plunger 42 in a direction 134 toward opening 106. With spring 40 expanding and exerting less force on rod 30, the biasing device of switch 22 may again overcome the force of spring 40 and return rod 30 and body 32 to their former relative positions as shown in FIG. 1, i.e., the open switch position. The force of spring 40 causes plunger 42 to move still farther in direction 134 until cup 50 abuts end walls 82, 84 and the entire tamper switch arrangement 10 is in the position as shown in FIG. 7. With plug assembly 20 no longer occupying opening 106, distal end 126 of shaft 52 may extend into or through opening 106. The loss of electrical connection between contacts 74, 76 terminates the transmission of the electrical signal to the alarm system and signifies to the alarm system that someone may have gained access to the device within enclosure 14.

As described above, tamper switch 22 may be biased back into the open switch position when door 104 is opened and/or enclosure 14 is moved away from surface 110 of plug assembly 20. Thus, tamper switch arrangement 10 of the present invention enables a single tamper switch to be used to detect both the opening of a door of an enclosure and the removal of the enclosure from a wall, floor, ceiling or post to which the enclosure is mounted.

Switch actuator 38 and spring 40 have been described herein as being operably coupled between tamper switch 22 and opening 106. Moreover, the elongate device formed by cantilever 90 and door strike 94 has been described herein as being operably coupled between tamper switch 22 and door 104. However, it is to be understood that it is within the scope of the present invention for a switch actuator and/or spring to be operably coupled between a tamper switch and an enclosure door, and for an elongate device to be operably coupled between the tamper switch and an enclosure opening.

Rail 18 has been disclosed herein as being separate from and attached to wall 109 of enclosure 14. However, it is also possible for the rail to be formed unitarily with the enclosure wall such that the wall itself includes a rail on which the tamper switch assembly may be slid to and fro.

While this invention has been described as having an exemplary design, the present invention may be further modified within the spirit and scope of this disclosure. This application is therefore intended to cover any variations, uses, or adaptations of the invention using its general principles.

What is claimed is:

1. A tamper switch arrangement for detecting tampering with a device, said apparatus comprising:

a tamper switch assembly including a tamper switch having a first part and a second part, said first and second parts being movable relative to each other between an open switch position and a closed switch position, said tamper switch being biased into one of the open and closed switch positions;

an enclosure configured to substantially enclose said tamper switch assembly and the device, said enclosure including a door and an opening disposed opposite said door, said enclosure being sized such that said tamper switch assembly may be compressed between an inner surface of said door and a second surface via said opening to thereby overcome the bias and actuate said tamper switch into an other of the open and closed switch positions; and a rail attached to a second inner surface of said enclosure, said tamper switch assembly being slidable on said rail in directions generally aligned with said door and said opening.

2. The apparatus of claim 1 wherein said tamper switch is biased back into said one of the open and closed switch positions when at least one of:

said door is opened; and said enclosure is moved away from the second surface.

3. The apparatus of claim 1 wherein said first and second parts are slidable relative to each other.

4. The apparatus of claim 1 wherein said opening comprises a throughhole.

5. The apparatus of claim 1 wherein said enclosure is sized such that said door may be closed to thereby compress said tamper switch assembly between said inner surface of said door and the second surface to thereby overcome the bias and actuate said tamper switch into the other of the open and closed switch positions.

6. The apparatus of claim 1 further comprising a plug configured to be attached to a fixed structure, said plug including the second surface, the second surface extending into said enclosure through said opening.

7. The apparatus of claim 1 wherein said opening is configured such that the second surface may extend into said enclosure through said opening.

8. The apparatus of claim 1 further comprising a spring disposed between said tamper switch and one of said opening and said door of said enclosure, said spring being configured to enable further compression of said tamper switch assembly after said tamper switch has been actuated into the other of the open and closed switch positions.

9. The apparatus of claim 1 further comprising an elongate device disposed between said tamper switch and one of said opening and said door of said enclosure, said elongate device having a length that is adjustable to set a level of compression of said tamper switch assembly.

10. A tamper detection assembly for placement within an enclosure, said assembly comprising:

a tamper switch including a first part and a second part, said first and second parts being movable relative to each other between an open switch position and a closed switch position, said tamper switch being biased into one of the open and closed switch positions, said tamper switch being configured to be compressed between an inner surface of a front door of the enclosure and a second surface via a rear opening of the enclosure such that the bias is overcome and said tamper switch is actuated into an other of the open and closed switch positions;

a spring configured to be operably coupled between said tamper switch and one of said opening and said door of said enclosure, said spring being configured to be compressed upon closing of the door after said tamper switch has been actuated into the other of the open and closed switch positions; and an elongate device coupled to said tamper switch, said elongate device having a length that is adjustable to set a level of compression of said tamper detection assembly, the elongate device including a first elongate element and a second elongate element, the second elongate element being selectively couplable to the first elongate element at a plurality of points along a length of said first elongate element.

11. The assembly of claim 10 wherein said tamper switch is biased back into said one of the open and closed switch positions when at least one of:

said door is opened; and said enclosure is moved away from the second surface.

12. The assembly of claim 10 wherein said first and second parts are slidable relative to each other.

13. The assembly of claim 10 wherein said opening comprises a throughhole.

14. The assembly of claim 10 wherein said spring is configured to be operably coupled between said tamper switch and the opening of the enclosure.

15. The assembly of claim 10 wherein the second surface comprises a surface of a fixed structure.

16. The assembly of claim 10 further comprising a plunger operably coupled to an end of said spring opposite said tamper switch.

17. A tamper detection assembly for placement within an enclosure, said assembly comprising:

a tamper switch including a first part and a second part, said first and second parts being movable relative to each other between an open switch position and a closed switch position, said tamper switch being biased into one of the open and closed switch positions, said tamper switch being configured to be compressed between an inner surface of a front door of the enclosure and a second surface via a rear opening of the enclosure such that the bias is overcome and said tamper switch is actuated into an other of the open and closed switch positions;

a spring configured to be operably coupled between said tamper switch and one of said opening and said door of said enclosure, said spring being configured to be compressed upon closing of the door after said tamper switch has been actuated into the other of the open and closed switch positions; and a housing containing said tamper switch, said housing having a groove configured to receive a rail such that said assembly is slidable on said rail relative to the enclosure in directions generally aligned with said door and said opening.

18. The assembly of claim 17 further comprising an elongate device coupled to said tamper switch, said elongate device having a length that is adjustable to set a level of compression of said tamper detection assembly.

19. The assembly of claim 18 wherein said elongate device includes a first elongate element and a second elongate element, said second elongate element being selectively couplable to said first elongate element at a plurality of points along a length of said first elongate element.

20. A tamper detection assembly for placement within an enclosure, said assembly comprising:

a tamper switch including a first part and a second part, said first and second parts being movable relative to each other between an open switch position and a closed switch position, said tamper switch being biased into one of the open and closed switch positions;

a switch actuator operably coupled to said tamper switch and configured to actuate said tamper switch into an other of the open and closed switch positions in response to said tamper detection assembly being compressed between an inner surface of a front door of the enclosure and a second surface via a rear opening of the enclosure, the switch actuator comprising a plunger and a spring, a first end of said spring being coupled to said plunger, and a second end of said spring being coupled to a first portion of the tamper switch; and an elongate device coupled to a second portion of the tamper switch, said elongate device having a length that is adjustable to set a level of compression of said tamper detection assembly.

21. The assembly of claim 20 wherein said tamper switch is biased back into said one of the open and closed switch positions when at least one of:

said door is opened; and said enclosure is moved away from the second surface.

22. The assembly of claim 20 wherein said first and second parts are slidable relative to each other.

23. The assembly of claim 20 wherein said opening comprises a throughhole.

24. The assembly of claim 20 wherein said switch actuator is configured to be operably coupled between said tamper switch and the opening of the enclosure.

25. The assembly of claim 20 wherein the second surface comprises a surface of a fixed structure.

26. The assembly of claim 20 further comprising a housing containing said tamper switch, said housing having a groove configured to receive a rail such that said assembly is slidable on said rail relative to the enclosure in directions generally aligned with said door and said opening.

27. The assembly of claim 20 wherein said elongate device includes a first elongate element and a second elongate element, said second elongate element being selectively couplable to said first elongate element at a plurality of points along a length of said first elongate element.

28. The assembly of claim 17 further comprising a plunger operably coupled to an end of said spring opposite said tamper switch.

29. The assembly of claim 28 wherein a first end of the spring is operably coupled to the plunger, and a second end of said spring is operably coupled to a first portion of the tamper switch, and further comprising an elongate device coupled to a second portion of the tamper switch, said elongate device having a length that is adjustable to set a level of compression of the spring.

30. The assembly of claim 17 wherein said tamper switch is biased back into said one of the open and closed switch positions when at least one of:

said door is opened; and said enclosure is moved away from the second surface.

* * * * *